United States Patent [19]

Libit

[11] Patent Number: 4,595,123

[45] Date of Patent: Jun. 17, 1986

[54] TAMPER EVIDENT CLOSURE CAP

[75] Inventor: Sidney M. Libit, Glencoe, Ill.

[73] Assignee: Owens-Illinois, Inc., Toledo, Ohio

[21] Appl. No.: 505,346

[22] Filed: Jun. 17, 1983

[51] Int. Cl.[4] ..... B65L 41/32

[52] U.S. Cl. ..... 222/23; 222/153; 222/556; 215/203; 215/217; 215/237; 215/256; 220/259; 220/338; 285/391; 285/901

[58] Field of Search ..... 222/153, 528, 531, 532, 222/556, 23; 215/251, 237, 254, 256; 220/266, 270, 335, 256, 259, 338; 285/391, DIG. 2

[56] References Cited

U.S. PATENT DOCUMENTS

| | | | |
|---|---|---|---|
| 2,123,546 | 7/1938 | Perkins | 222/532 |
| 3,250,436 | 5/1966 | Kurtz | 222/153 |
| 3,251,509 | 5/1966 | Foster | 222/153 |
| 3,303,971 | 2/1967 | Stevens | 222/153 |
| 3,503,544 | 3/1970 | Setera | 222/556 |
| 3,853,250 | 12/1974 | Alpern | 222/517 |
| 4,081,108 | 3/1978 | Wilson et al. | 222/532 X |
| 4,124,151 | 11/1978 | Hazard | 222/556 X |
| 4,291,818 | 9/1981 | Nozawa et al. | 222/517 X |
| 4,346,810 | 8/1982 | Kneissl | 215/237 |
| 4,361,250 | 11/1982 | Foster | 222/153 X |

FOREIGN PATENT DOCUMENTS

| | | | |
|---|---|---|---|
| 2041891 | 9/1980 | United Kingdom | 222/556 |

*Primary Examiner*—Joseph J. Rolla
*Assistant Examiner*—Frederick R. Handren
*Attorney, Agent, or Firm*—John R. Nelson

[57] ABSTRACT

A tamper indicating closure cap of the type having a pivotable stopper closing a cap top orifice. The stopper has an integral flange overlying portions of the top and extending behind the pivotable member to preclude pivoting of the pivotable member. The flange is removable from the pivotable member and indicia formed in the container top underlying the flange is made visible by removal of the flange.

22 Claims, 11 Drawing Figures

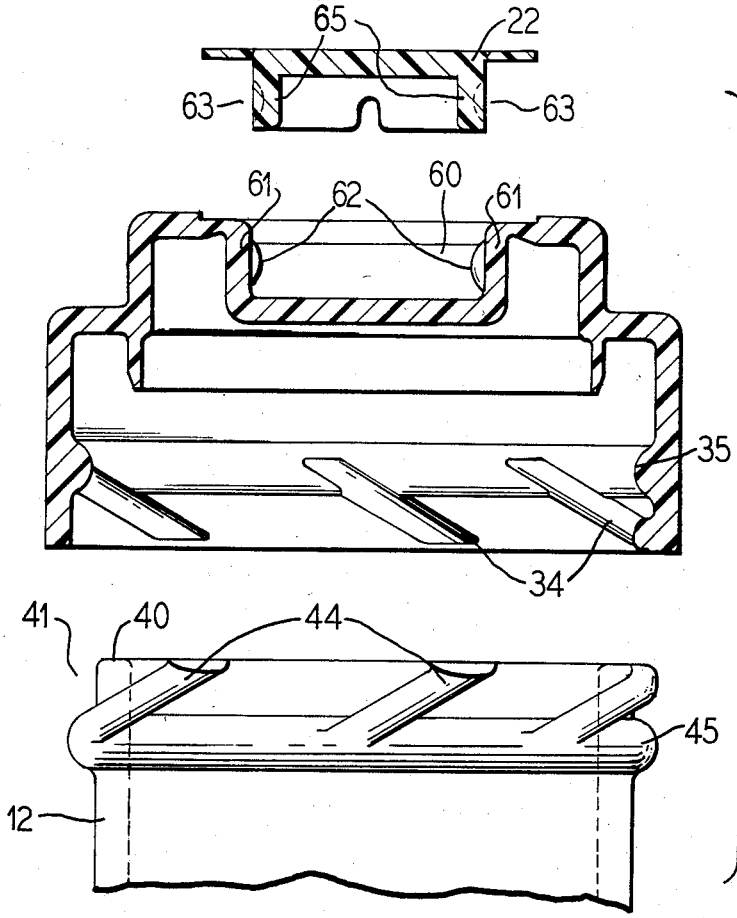
FIG. 6
FIG. 7
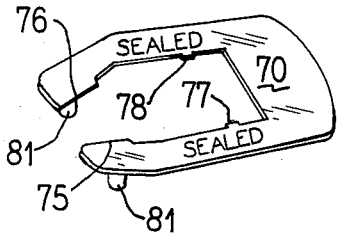
FIG. 8
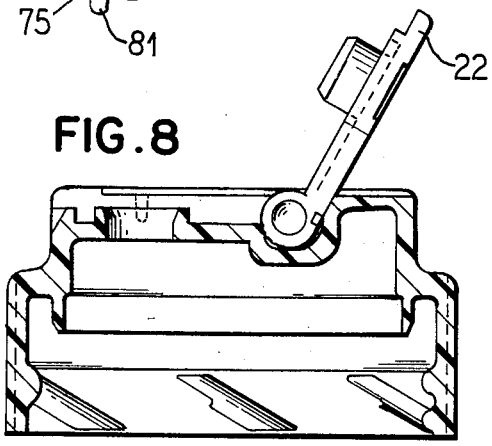
FIG. 9
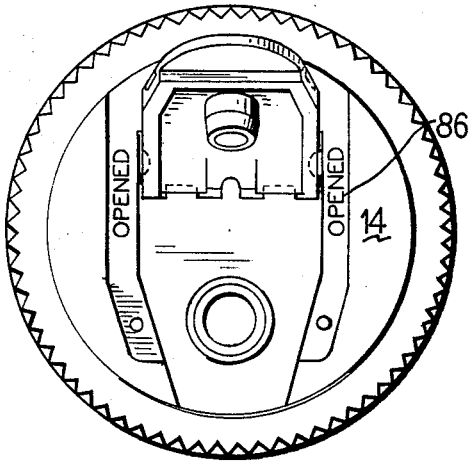

TAMPER EVIDENT CLOSURE CAP

BACKGROUND OF THE INVENTION

1. Field of the Invention

This invention relates to container closures and more particularly to a tamper evidencing container closure.

2. Prior Art

Recently, a heightened emphasis has been placed upon utilization of tamper proof or tamper evident closures for containers, particularly containers utilized for human ingestible materials.

A known class of such containers employs caps or closures having dispensing orifices therethrough. Such orifices may be used in connection with, for example, squeeze bottles or the like, and frequently include a two section cap, a first section including a base top surface having the orifice therethrough and a second section forming a stopper for the orifice. In such caps, the stopper portion is movable from an orifice closing to an orifice opening position. The stopper carrying member may either be an integral part of the closure, as shown, for example, in U.S. Pat. No. 4,124,151, or may be formed as a separate but attached piece as shown, for example, in my co-pending allowed patent application entitled "Dispensing Type-Cap Closure" Ser. No. 326,416, filed Dec. 1, 1981, now U.S. Pat. No. 4,441,637 the teachings of which are herein incorporated by reference.

Such stopper members must, of necessity, be relatively easy to open to allow the container to be used for its intended purpose. However, ease of opening of the stopper allows for possible tampering with the contents to occur. While it has been known to utilize foil or paper seal overlays covering the stopper member, which overlays must be broken or removed prior to openings, such overlays are not a sufficient detriment to tampering, as in the case of stick on overlays which might be surreptitiously opened by steaming or the like, or are an undesired added expense.

It has also been known to make the stopper member physically a part of the cap and to provide a tear strip portion in the connection of the cap to the stopper member (see U.S. Pat. Nos. 3,255,928; 3,651,992; and 4,081,108). While such tear strip portions provide an indication of tampering, they require that the stopper member be molded as a part of the cap, an expensive procedure.

It would therefore be an advance in the art to provide an attached stopper dispensing orifice type closure having means preventing opening of the stopper which means are easily removable but which, when removed, provide an indication of tampering and which means further are both inexpensive and difficult to circumvent.

It would be a further advance in the art if such a tamper evident closure could be provided in connection with a easily attached substantially non-removable cap-container interface.

SUMMARY OF THE INVENTION

This invention provides a container cap of the dispensing orifice type where the cap includes a cup shaped base cap having a dispensing orifice molded in a top portion and a pivotable stopper member carried by the base pivotable from an orifice closing position to an orifice opening position, the stopper carrying member having associated therewith a skirt which overlies portions of the base cap top on the side of the pivot opposite the stopper to thereby preclude pivoting of the stopper. The skirt portion is removable from the pivoting member and, when removed, allows the stopper to be moved to the open position. Removal of the skirt portion provides evidence of tampering.

In a preferred embodiment, the stopper is formed as a pivotable member having a stopper adjacent one end and a pivot section adjacent another end, the pivot section being received in a depressed socket in the top of the cap base. The skirt is formed as an integral portion with the pivotable member extending from adjacent the stopper end to beyond the pivoted end overlying a full height portion of the cap beyond the socket. The skirt extends outwardly to both sides of the pivotable member and is separated from the pivotable member by gaps along portions of the side walls of the pivotable member and at the back of the pivotable member adjacent the pivot. Other portions of the skirt are integral with the pivotable member. The skirt has a portion projecting beyond the cap top to allow grasping from the other side. The skirt portion can therefore be ripped from the pivotable member, freeing the pivotable member to pivot.

In one embodiment disclosed, the skirt portion may have indicia printed thereon indicating that the container is sealed and the cap may have indicia printed thereon, underlying the skirt portion indicating that the container has been opened. Thus, removal of the skirt portion will expose the underlying indicia indicating that the container has been tampered with.

In a further embodiment, the skirt may be provided with undersurface projecting bosses or barbs which engage with the cap base to firmly affix the skirt to the cap base. Such bosses or barbs can be designed so that the skirt can be removed from the top substantially only upon separation of the skirt from the pivotable member.

In a further modification of this invention, the base cap includes a depending skirt having an inner diameter raised circumferential bead and partial threads extending upwardly from the skirt bottom and running out in the bead. The cap is used in connection with a container having a neck having a circumferentially raised outer diameter bead and partial threads extending from the neck top downwardly to and running out in the bead. The neck bead has a larger outer diameter than the inner diameter of the cap bead and the cap is formed of a semi-resilient material allowing the cap skirt to be circumferentially expanded so that the beads can pass one another and rest in a cap attached bead overlying position with the neck bead positioned above the cap bead. In this manner, a substantially non-removable cap-container connection is made which, when combined with the tamper indicating stopper member, provides security for the contents of the container.

It is therefore a principal object of this invention to provide an improved tamper indicating container closure.

It is another common and more specific object of this invention to provide an improved tamper indicating container closure of the type having a dispensing orifice in the closure cap closed by pivotable stopper member with means to prevent pivoting of the stopper member, said means being removable and the removal thereof indicating tampering.

It is another specific object of this invention to provide a tamper resistant container closure including a cap adapted to be received on the neck of a container with cap removal resisting means on the inner diameter of the cap skirt and the outer diameter of the container neck, which means abut one another resisting removal of the cap, the cap having a dispensing orifice through a top thereof and an associated pivotable stopper member carried by the cap, pivotable from an orifice closing position to an orifice opening position, the pivotable member having an integrally molded skirt associated therewith overlying flat portions of the top preventing movement of the pivotable member from the orifice closing position, the skirt portions being removable from the pivotable member and removal of the skirt portions indicating tampering with the container.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 6 is an expanded partially sectional view of the closure cap and container neck with the section being substantially the same as the section of FIG. 4.

FIG. 7 is a perspective view of a removable portion of the spout skirt.

FIG. 8 is a view similar to FIG. 2 illustrating the cap spout in an open position.

FIG. 9 is a view similar to FIG. 3 illustrating the cap spout in an open position.

DESCRIPTION OF THE PREFERRED EMBODIMENTS

Figure 1:
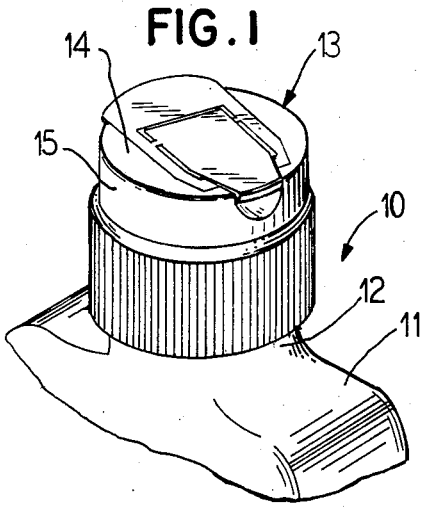
FIG. 1 is a fragmentary perspective view of a container and closure cap according to this invention.

FIG. 1 illustrates a container enclosure combination 10 including a container 11 which may be of any desired shape, the container having a neck portion 12 terminating in the throat opening, the throat opening being closed by a cap member 13 which includes a top 14 and depending circumferential skirt 15.

Figure 2:
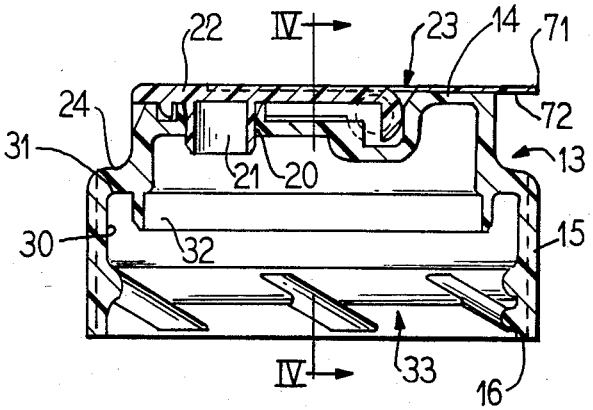
FIG. 2 is a cross-sectional view of the closure cap of FIG. 1 with the section taken longitudinally of the stopper.

As more clearly shown in the cross-section FIG. 2, the cap 13 includes a substantially elongated skirt 15 terminating in a bottom open end 16 and merging with the top 14 at the other axial end. The top may be a multi-tiered configuration as shown in the cross-section or, if desired, could be a single flat top portion. In the embodiment illustrated, the top is of the type having a pouring orifice 20 closed by a stopper 21 which is formed on the undersurface of a hinged member 22, the hinged member being pivotably recieved in a socket 23 formed in the central portion of the top 14. Additionally, the top may flare outwardly as at 24 to an axially knurled wall forming the major portion of the skirt 15.

The interior of the cup shaped cap includes an inner diameter wall 30 of the skirt 15, a container engaging undersurface 31, a container plug 32 and a threaded and beaded section of the skirt 33.

The threaded and beaded section 33 of the skirt inner diameter includes a plurality of partial threads 34 which extend spirally upward from the bottom or from adjacent the bottom 16 and which run out in a diameter reducing raised bead 35. The bead is spaced intermediate the axial ends of the skirt between the container engaging undersurface 31 and the open axial end 16. Above the bead 35 the inner diameter of the skirt wall remains substantially constant at a diameter greater than the diameter of the bead. The constant diameter area 38 is dimensioned with respect to the bottle neck as is more fully explained hereafter.

The container or bottle neck 12, as most clearly shown in FIG. 6, terminates in an annular open top 40 and includes a threaded and beaded area 41 extending downwardly from the top. The threaded area includes a plurality of partial helical threads 44 which are dimensioned to properly engage the closure threads 34. The threads 44 run out in a circumferentially raised bead 45. The bead 45 has an outer diameter which is greater than the inner diameter of the bead 35.

Figure 5:
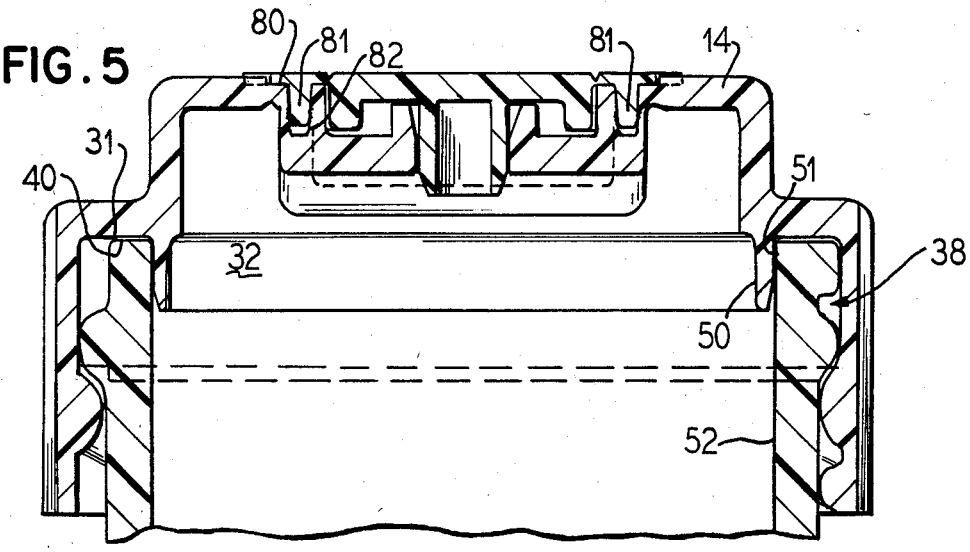
FIG. 5 is an enlarged fragmentary cross-sectional view of the closure cap and container neck taken substantially along the line V—V of FIG. 3.

The threads 34, 44, and beads 35, 45, are dimensioned such that engagement and rotation of the threads will cause the cap to be drawn downwardly onto the neck 12. Continued rotation will force the circumferential expansion of the skirt 15 of the closure cap as the top of the bead 45 engages the underside of the bead 35. Further rotation will cause the skirt to expand sufficiently for the bead 45 to pass the bead 35. The threads 34 and 44 are continued in axial distance sufficient to insure that the beads will be urged past one another or at least until the downslope on the underside of the bead 45 is begun to engage the downslope on the upper side of the bead 35. At this point, the threads will run out and no longer engage one another. Due to the resilient nature of the material of the cap, which may be formed of resilient plastics, the beads will be urged past one another to the position shown in FIG. 5. In this position, the resiliency of the material of the skirt will circumferentially constrict the skirt to the point where the beads are radially overlapping and axially abutting, as shown in FIG. 5. Since the threads are no longer in engagement, and since there are no threads below the bead of the neck or above the bead of the closure cap, any further rotation, in either direction, of the closure cap with respect to the bottle neck, will not cause relative axial movement between the two.

As best shown in FIG. 5, the area 38 between the cap bead 35 and the undersurface 31, and radially between the skirts inner diameter and the plug 32 outer diameter, is preferably dimensioned with respect to the radial thickness of the container neck and the axial length of the container neck from the bead 45 to the annular open end 40 to provide a snug fit for sealing purposes. It will be appreciated that, in those embodiments where complete circumferential beads 35 and 45 are used, that by dimensioning the axial length of the space 38 so that the top 40 of the neck engages the undersurface 31 of the top when the beads 35, 45, are in axial abutment, that both a seal will be formed between the undersurface 31 and the top 40 and a secondary seal will be formed at the bead engagements.

In certain embodiments, however, it may be desirable to use less than circumferential beads in order to provide the axial abutment of radially overlapped members. For example, if the threads of the cap are formed with abutting top end portions, the threads tops may themselves act as the abutment member for engagement with the undersurface of a container neck bead. In such instances, it may be desirable to make the container neck bead somewhat flattened on its undersurface to provide a secure abutment. In those instances, a circumferential seal will not be provided at the bead but a circumferential seal may still be provided at the engagement between the undersurface 31 and the top 40.

Moreover, sealing of the container can be enhanced by use of the plug 32. In the embodiments illustrated, the plug 32 consists of a depending axial wall 50 having an outer diameter 51 substantially equal to the inner diameter 52 of the container neck. As is known, such plugs may be force fit utilizing the resiliency of the plastic of the cap to allow a slightly oversized plug outer diameter 51 to be forceably insertable into the throat of the neck. Additionally, as is known, the plug outer diameter may be provided with individual sealing ribs or other sealing surface configurations.

It will of course be appreciated that although in this instance a circumferential wall 50 is utilized as the plug, which depends from the central portions of the top. In other instance a solid plug may be utilized or the plug may be formed of a U-shaped cross-section convolution of the top material or otherwise. By dimensioning the space 38 radially from the plug outer diameter to the skirt inner diameter consistent with the maximum thickness of the neck of the container, which thickness will include the threads 35 which run out adjacent the top 40, it can be assured that the container will be adequately sealed.

It will be apparent from the description thus far that the container neck and closure cap described provide a substantially non-removable cap which can be applied to the container by standard capping machinery used for applying threaded caps to threaded necks. A substantial axial force during application is not necessary since the axial force required to cause the skirt to expand to allow the beads to pass one another is derived from the rotational force imparted to the cap. That rotational force is converted, in part, to an axial thrust because of the engagements of the helix threads. This allows the cap of this invention to be used in connection with thin wall or other easily compressible containers. Once the cap is fully applied to the bottle neck with the beads overlapping as shown in FIG. 5, a substantially non-removable container closure is provided. In order for the container closure to be removed, it will be necessary to expand the skirt to where the beads are no longer in engagement. By proper choice of the skirt dimensions and materials, it can be substantially assured that, while ease of application is maintained, removal will be substantially precluded.

In those instances where the cap top has a dispensing orifice such as the orifice opening 20, and a movable member having a stopper for the orifice such as the pivotable closure 22 with stopper 21, it is frequently desired to preclude tampering with the contents by means of the orifice. Moreover, the means to preclude tampering with the contents should, ideally, provide evidence of prior openings.

This invention contemplates the provision of a mechanism to limit pivoting of the orifice closure in a manner to prevent opening of the orifice. The means is removable to allow opening of the orifice but, in its removed state, it provides an indicia of prior tampering. The principal indicia is the absence of the removed means. As a secondary indicia, the portion which is to be removed may overlie printed indicia stating that the container has been tampered with.

As shown in FIG. 6, the top is formed with a recess 60 molded therein having sidewalls 61 from which opposed dimples 62 project into the area of the recess 60. The dimples 62 are dimensioned to pivotably interlock with recesses 63 formed in sidewalls 65 adjacent the flange end of the stopper member or orifice closure 22. For a fuller understanding of the nature and construction of the pivotable closure member 22 and socket 60, see my co-pending allowed application for patent Ser. No. 326,416, entitled "Dispensing Type Cap Closure", filed Dec. 1, 1981.

Figure 3:
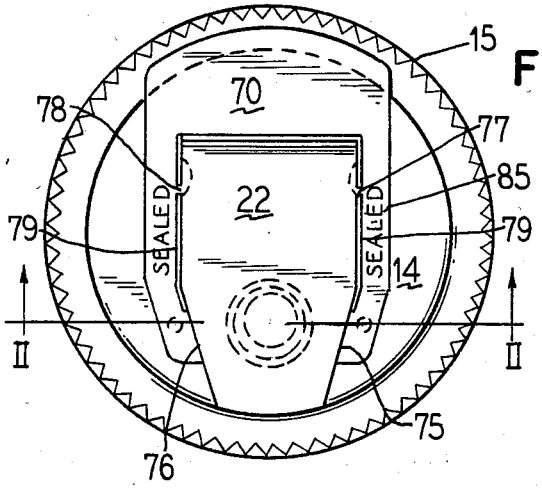
FIG. 3 is a top elevational view of the closure cap of FIG. 1.
Figure 4:
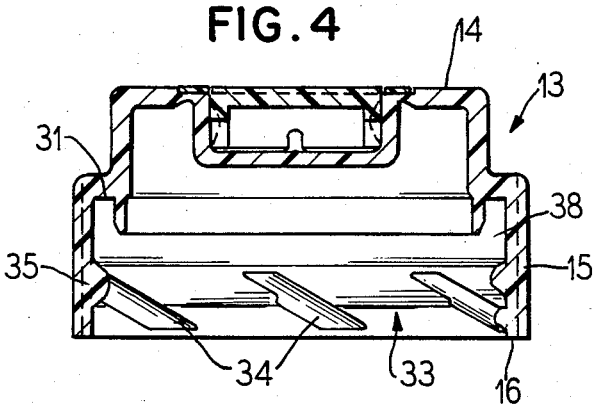
FIG. 4 is a cross-sectional view of the closure cap of FIG. 1 taken substantially along the lines IV—IV of FIG. 2.

As will be evident from FIG. 3, in connection with FIG. 2, the pivotable portion 22 overlies a central portion of the top 14 of the cap, the portion overlied may, for example, include a depressed area to allow the pivotable portion 22 to lie flush with the remainder of the top or substantially flush with the remainder of the top.

In order to prevent pivoting of the portion 22, I have provided a commonly molded flange member 70 which extends outwardly to the sides and to the back of the pivot portion 22 and which overlies portions of the top 14. The flange 70 may have a tail portion 71, illustrated in FIG. 2, which extends backwardly beyond portions of the top 14 to provide an overhang 72 for grasping of the tail portion from the underside.

The flange 70 is, in the preferred embodiment, integrally molded with the pivot portion 22 and is attached thereto at points 75 and 76 adjacent the stopper end of the pivotable member 22 and at points 77 and 78 adjacent to the pivot axis formed by the recesses 63. In the remaining areas, the flange may be separated from the pivot member by gaps 79.

As long as the flange 70 remains attached to the pivot member 22, pivoting of the pivoting member with respect to the top 14 will be precluded because of the inability of the flange 70 to pivot since it is in substantial surface-to-surface contact with the top 14.

In order to enhance the attachment, the undersurface 80 of the portions of the flange overlying the top 14 of the cap, adjacent the attachments 75, 76, may be provided with projecting bosses 81 which are received in bores 82 formed into the material of the cap from the top thereof. The bosses 81 may be barbed to lock into the bores, or may be otherwise affixed to the bores. The bores may be through bores with the bosses projecting all the way through to the undersurface of the cap where they could be headed by cold or hot heading techniques if desired.

The principal function of the bosses is to lock the front portion of the flange adjacent to the stopper end of the pivotable member 22 to the top of the cap. Because the attachment areas 75 and 76 are relatively long along the length of the member 22, a significant force will have to be applied to break the attachment of the pivotable member to the flange. By locking the flange to the cap top, it will be assured that the pivotable member 22 will not be easily openable absent prior removal of the flange 70.

The attachment points 77 and 78 may be shorter than the attachment points 76 and 75 and therefore more easily frangible. Moreover, the attachment points 77 and 78 are spaced from the tail end 71 and provide a somewhat lever type action to breaking the skirt from the pivotable member at the area 77, 78 when the tail 71 is pulled upwardly. Further pulling of the tail 71 will cause separation to occur in the areas of attachment 75, 76, thus freeing the pivotable member 22 from the flange 70. During this separation, the bosses 81 may either be pulled out of the bores 82 or may break off, remaining with the cap.

It will, of course, be appreciated that the exact extent of the attachment areas 75–78 will depend upon the material chosen and the desired force parameters for removal of the flange.

FIG. 7 illustrates the flange 70 in its removed condition with the bosses 81 remaining attached to the flange. In this instance, it will be seen that the attachment points 75–78 have been sheared from the pivotable member 22, which in FIG. 8 is shown in its open position.

In order to provide a readable indicia of tampering, as shown in FIG. 3, the skirt may be provided with written indicia 85 indicating that the container is sealed. The top 14, on the other hand, may be provided with underlying written indicia, normally covered by the skirts 70, indicating that the container has been tampered with. For example, the word "sealed" may be used on the skirt, as shown in FIG. 3 at 85, and the word "opened" provided in the underlying area as indicated at 87 on FIG. 9.

Although I have thus far shown a sealed, tamper evident substantially unremovable closure, it is frequently desired that after intentional opening by the ultimate customer, that the cap be thereafter easily removable while retaining the ability to be sealingly replaced. Such a feature can be easily provided on the cap of this invention, as more clearly shown in FIGS. 10 and 11.

Figure 10:
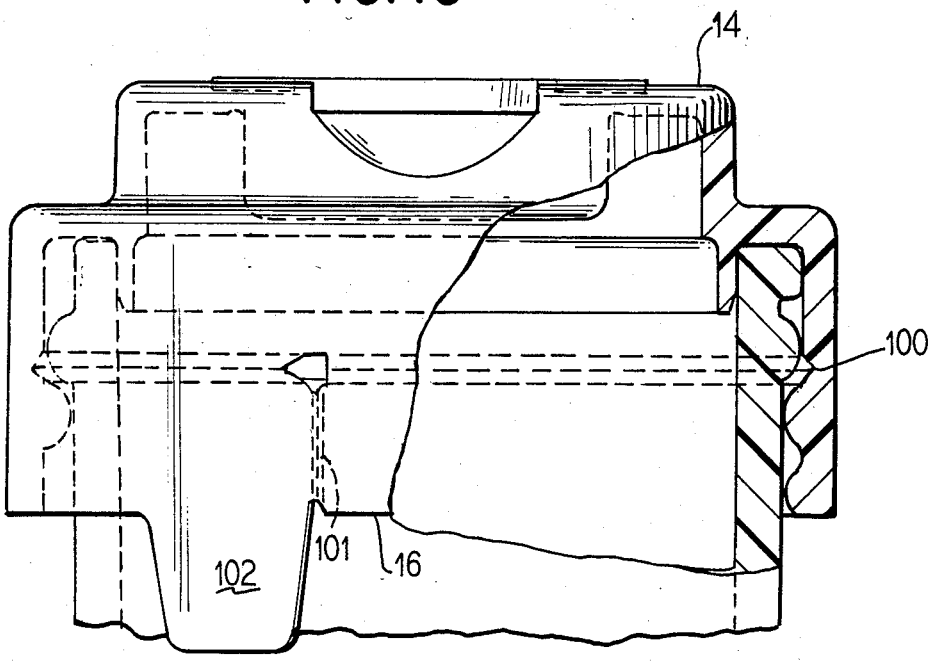
FIG. 10 is a fragmentary partially sectional view of the closure cap and container illustrating a modified form of the closure cap.

Since removability of the cap is inhibited by the overlapped abutment of the beads 35 and 45, in FIG. 10 I have provided a mechanism for removal of the cap bead 35. To this end, the cap skirt may be formed with a fracture line or circumferential weakening 100 lying above the bead. In addition, the cap skirt, in the area from the fracture line or weakening 100 axially to the end 16 may be provided with a further fracture line or weakening 101. By providing a grasping tab 102 adjacent to the fracture line 101, an easily removable tear strip results. Thus, by grasping the tab 102 and pulling it upward towards the top 14, the skirt portion will fracture along the line 101, thus breaking the circumferential integrity of the skirt. Further drawing of the tab chordally of the skirt will cause the bottom portion of the skirt to separate along the fracture line 100 around the entire circumference of the cap. After separation of the bottom portion of the skirt, including the bead 35 and partial threads 34, the radially overlapped resistance to removal provided by the beads will be eliminated, and the remaining portion of the cap can thereafter be removed from the container relatively easily.

However, because of the sealing nature of the plug 32, as well as the remaining upper portion of the skirt surrounding the space 38, an easily replaceable cap portion will be retained. This upper portion will maintain a sealing capability.

Figure 11:
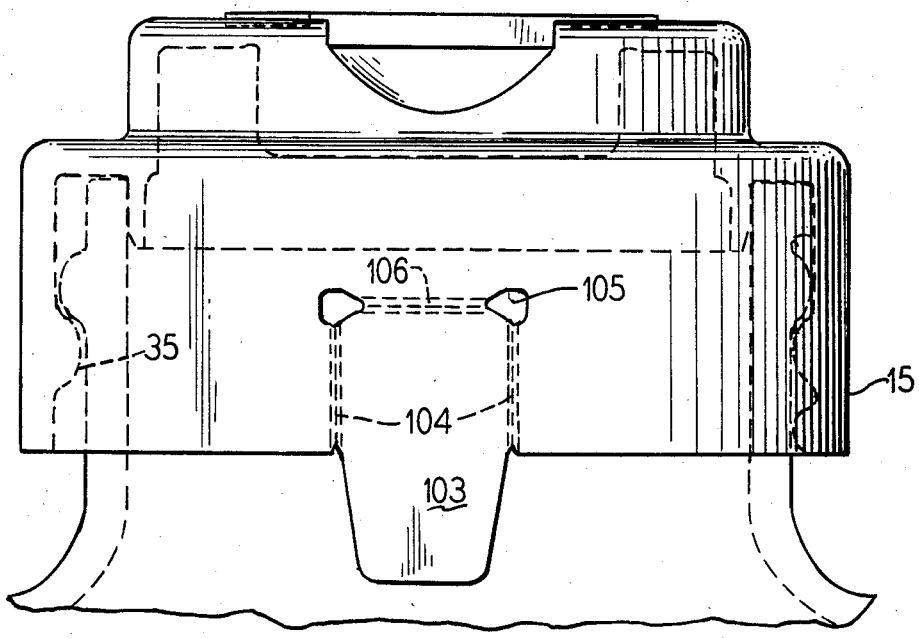
FIG. 11 is a fragmentary side elevational view of the closure cap and container illustrating another modification of the closure cap.

FIG. 11 illustrates a variant of the means for removing the non-removability feature. In this embodiment, a tab 103 is provided having parallel vertical fracture areas 104 of the skirt which extend upwardly above the bead 35 and terminate in a part circumferential fracture line 106. Thus, by pulling on the tab 103, a circumferential section of the lower portion of the skirt 15, including the bead 35 and any underlying portion of the partial threads, will be removed, thereby substantially weakening the resistance to circumferential expansion of the lower portion of the skirt. This will allow ease of removeability of the cap. If desired, to increase the removability of the tabs 102, 103, cut out portions at the intersection of the axially and circumferentially extending weakened areas can be provided as illustrated at 105. In other instances, it may not be necessary to provide the cut out areas 105.

It will be further appreciated that although FIGS. 10 and 11 show stepped tops provided with pivotable closures 22, that this removability feature may be used in connection with other cap designs, including straight top closures not having pivotable members or dispensing openings.

Although the teachings of my invention have herein been discussed with reference to specific theories and embodiments, it is to be understood that these are by way of illustration only and that others may wish to utilize my invention in different designs or applications.

I claim as my invention:

1. A tamper resistant container cap structure comprising a container cap including a top having a top surface with a socket formed therein, said surface having a dispensing orifice therethrough, said socket spaced from said orifice, a stopper for said dispensing orifice formed on the undersurface of a pivotable member, said pivotable member extending into and pivotably received in said socket to allow pivotable movement of said stopper from an orifice closed position to an orifice opened position, a flange member integrally molded with said stopper, said flange member having a portion thereof extending over and engaging a portion of said top surface on a side of said socket opposite the orifice, movement of said stopper from said orifice closed position to said orifice opened position being resisted by the engagement of said flange member with said top surface, means for quick removability of said flange member from said stopper, removal of said flange member from said stopper providing an indication of tampering with said closure, and removal of said flange member from said stopper causing complete severance of said flange member from said stopper and said cap for discarding of said removed flange member.

2. A cap structure according to claim 1, wherein said pivotable member is elongated between said socket and said stopper, said flange member extending along the longitudinal length of said pivotable member from at least adjacent said stopper to beyond said socket on both sides of said pivotable member, frangible connections between said flange member and said pivotable member.

3. A cap structure according to claim 2, wherein said frangible connections are located adjacent the stopper on both sides of said pivotable member and adjacent the pivot axis thereof on both sides of said pivotable member.

4. A cap structure according to claim 3, wherein the frangible connections adjacent said stopper are elongated with respect to the frangible connectiosn adjacent said pivot axis.

5. A cap structure according to claim 4, wherein means are provided for affixing said flange member to said top.

6. A cap structure according to claim 5, wherein said means for affixing include projections on an undersurface of said flange member integral therewith, said projections extending into bores in said top.

7. A cap structure according to claim 6, including means for retaining said projections in said bores.

8. A cap structure according to claim 7, wherein said projections are broken off in said bores during removal of said flange member from said pivotable member.

9. A cap structure according to claim 8, wherein said flange member has a portion thereof extending beyond said socket on the opposite side of said socket from said orifice, said portion extending beyond a sidewall portion of said top whereby said portions overhangs a sidewall portion of said top.

10. A cap structure according to claim 9, wherein said sidewall is of reduced radius than other sidewall portions of said cap whereby said overhang does not extend beyond the major outer diameter of said cap.

11. A cap structure according to claim 6, wherein said pivotable member is attached to said top by a snap connection at said pivot axis and said flange is attached to said top by said means for affixing.

12. A cap structure according to claim 11, wherein said cap is affixed to the neck of a container, said cap and said container having mutually opposed diameter changing configurations which radially overlie one another preventing removal of said top from said container, said diameter changing configurations consisting of radially inwardly extending diameter reducing inner diameter configurations on portions of said cap and radially outwardly extending, diameter increasing, outer diameter configurations on portions of said container.

13. A cap structure of claim 12, wherein the diameter changing configurations comprise a depending skirt on said top, an inner diameter raised bead on said skirt, a projecting neck on said container, an outer diameter raised bead on said neck, the diameter of the outer diameter bead being greater than the inner diameter of the inner diameter bead.

14. A cap structure according to claim 13, including mutually engageable threads on said skirt and said neck for attaching said cap to said neck by threaded rotational engagement, said threads extending for only a part of the inner diameter axial length of said skirt and for only a part of the axial length of said neck, said threads running out of at said beads whereby when said cap is fully seated on said neck, said neck threads and cap threads are not engaged.

15. A cap structure according to claim 14, wherein means are provided for removing a portion of the bead of said skirt.

16. A dispensing closure comprising a cap portion including a top having a top surface, a socket portion recessed in said top, a dispensing opening through said top spaced from the socket, said socket having an end wall portion and side wall portions, a closure member having a rear and a depending stopper spaced from the rear for closing the dispensing opening, a pivot connection between the closure member and the cap at said socket comprising snap together rotatable connections between said side wall portions of said socket and side wall portions of said closure member adjacent said rear, said closure member movable about the pivot connection from a first position with the stopper closing the dispensing opening to a second position with the stopper elevated above the top surface, said rear moving in said socket during movement from said first position towards said second position, a flange integrally molded with said closure, said flange overlying portions of said top surface adjacent said closure member, said flange having a tail portion thereof extending beyond said rear and said socket remote from said dispensing opening and overlying portions of said top surface, said tail portion preventing movement from the first position to the second position, frangible connection means connecting said flange to said closure member, breaking means including said tail portion for breaking said frangible connections and separating said flange from said closure member, the removal of said flange from said closure member providing an indication of tampering with said dispensing closure.

17. A dispensing closure according to claim 16, including affixing means affixing said flange to said cap.

18. A dispensing closure according to claim 17, wherein said affixing means comprise projecting bosses on the undersurface of said flange and aligned bores in said cap dimensioned to receive said projecting bosses.

19. A dispensing closure according to claim 18, including further affixing means for securely affixing said bosses in said bores.

20. A dispensing closure according to claim 15, wherein said top has indicia thereon in an area underlying said flange, said indicia indicating that said stop has been tampered with.

21. A dispensing closure according to claim 20, wherein said flange has indicia thereon indicating that said dispensing closure has not been tampered with.

22. A dispensing closure according to claim 20, wherein said bosses are frangible from said flange and remain attached to said cap when said flange is separated from said closure member.

* * * * *